United States Patent [19]

Namba et al.

[11] Patent Number: 5,076,563

[45] Date of Patent: Dec. 31, 1991

[54] APPARATUS FOR CONTROLLING A SHEET SUPPLYING DEVICE

[75] Inventors: Toyoaki Namba, Nara; Motoaki Okitsu, Koriyama; Ken-ichi Iwamoto, Nara; Yoshikado Yamada, Kashihara; Yuuji Sugimoto, Nara, all of Japan

[73] Assignee: Sharp Kabushiki Kaisha, Osaka, Japan

[21] Appl. No.: 523,796

[22] Filed: May 15, 1990

[30] Foreign Application Priority Data

May 16, 1989 [JP] Japan ..... 1-122494

[51] Int. Cl.[5] ..... B65H 5/00

[52] U.S. Cl. ..... 271/10; 271/110; 271/122; 271/114; 271/116; 271/258

[58] Field of Search ..... 271/10, 113, 110, 111, 271/114, 116, 119, 120, 122, 127, 258, 259, 902

[56] References Cited

U.S. PATENT DOCUMENTS

| | | | |
|---|---|---|---|
| 3,857,559 | 12/1974 | McInerny | 271/122 |
| 3,961,786 | 6/1976 | Yanker | 271/10 |
| 4,709,911 | 12/1987 | Saiki et al. | 271/122 |
| 4,822,023 | 4/1989 | Miyoshi | 271/122 |

FOREIGN PATENT DOCUMENTS

| | | | |
|---|---|---|---|
| 57-23971 | 6/1982 | Japan . | |
| 0167836 | 8/1985 | Japan | 271/122 |
| 0257843 | 11/1986 | Japan | 271/110 |

*Primary Examiner*—H. Grant Skaggs

*Attorney, Agent, or Firm*—David G. Conlin; Robert M. Asher

[57] ABSTRACT

An apparatus for controlling a sheet supplying device having a feeding device capable of feeding a copying sheet from a plurality of stacked copying sheets in a sheet stacking portion and a reversing device capable of returning copying sheets desired not to be fed at an instance of feeding process includes an unit for applying a rotational driving force to the feeding device so as to draw a copying sheet out of the stacked copying sheets in the sheet stacking portion by rotating the feeding device in one direction, and an unit for applying a rotational driving force to the reversing device so as to return a copying sheet desired not to be fed to the sheet stacking portion at a time when a plurality of copying sheets are simultaneously fed out from the sheet stacking portion by rotating the reversing device in another direction. The apparatus also includes an unit for controlling both of the applying units such that the rotational driving force applied to the feeding device is stopped at a time when a copying sheet to be fed has passed on the feeding device and the rotational driving force applied to the reversing device is kept to apply to the reversing device at least for a predetermined time period after stopping to apply the rotational driving force to the feeding device. The applying unit for applying the rotational force to the feeding device is capable of applying a rotational force which is enable to rotate the feeding device in the another direction. The controlling unit is capable of applying a rotational driving force to the feeding device so as to rotate in the another direction for a constant time period.

19 Claims, 10 Drawing Sheets

APPARATUS FOR CONTROLLING A SHEET SUPPLYING DEVICE

BACKGROUND OF THE INVENTION

1. Field of the Invention

The present invention relates to an apparatus for controlling a sheet supplying device for introducing sheets stacked in a cassette into a predetermined conveyance path and preventing the supplying of a sheet which must not be fed in the case where a multiplicity of sheets are simultaneously fed.

2. Description of the Related Art

The inventors of the present invention know copying machines which have been arranged such that a plurality of sheet cassettes are provided in a desk disposed below the copying machine body so that copying sheets of various sizes are accommodated depending upon the desired sheet supplying directions. Thus, a desired copying sheet is selected so as to easily change the copying sheet as much as possible (refer to Japanese Patent Laid-Open No. 61-192637).

The copying machine of the type described above has a sheet supplying device for supplying the copying sheets stacked in a sheet cassette to the sheet conveyance path, and the sheet supplying device is disposed above the sheet supplying side of the sheet cassette. Although the sheet supplying device of this type is arranged to supply the copying sheets one by one, two sheets may be simultaneously and undesirably fed (double feed) since the copying sheets are sticked together due to static electricity.

Accordingly, the sheet supplying devices having a device for overcoming the above-described problem has been invented by many inventors. For example, a known device which has been disclosed in Japanese Patent Laid-Open No. 53-129648 for preventing the double feed. That device has a pad so arranged that it can be brought into contact with a roller and separated from the roller, and the frictional coefficient of the pad is made smaller than that of the roller.

However, according to the above-described sheet supplying device, the conveyance of only the lower copying sheet of the two copying sheets is prevented for the purpose of preventing the double feed. Therefore, the copying sheet is sometimes left with projecting over the cassette even if the pad is separated from the roller. As a result, when the cassette is drawn from the desk for feeding the copying sheets or eliminating the jamming of the copying sheets, the copying sheet left as described above comes in contact with the sheet supplying device and is damaged.

In particular, in the case where the above-described sheet cassette is a rotatable sheet cassette with which the copying sheets can be supplied either longitudinally or sideways, the sheet is rotated for the purpose of changing the supplying direction. Therefore, the copying sheet can be easily damaged, causing a difficulty in supplying the copying sheet.

It might therefore be feasible to employ a structure arranged such that a sheet returning plate is provided therein, and the sheet returning plate pushes the leading edge of the copying sheet for preventing the supplying of the copying sheet on the tangent line between the sheet supplying roller and the pad so as to return the copying sheet to the sheet cassette.

However, even if the sheet returning plate of this type is provided, the sheet returning plate cannot reach the leading edge of the copying sheet and the sheet returning operation cannot thereby be conducted in the case where the leading edge of the copying sheet which must not be fed exceeds the roller tangent line and is stopped there. For example, if three copying sheets have been simultaneously fed (triple feed), the upper copying sheet is fed by the sheet supplying roller and the supplying of the lower copying sheet is prevented by preventing device such as a pad. However, the intermediate copying sheet is conveyed together with the upper copying sheet, and is stopped at a position exceeding the roller tangent line.

SUMMARY OF THE INVENTION

It is therefore an object of the present invention to provide an apparatus for controlling a sheet supplying device arranged such that copying sheets stacked in a cassette are introduced into a predetermined conveyance path and the supplying of the copying sheet which must not be fed is prevented when a plurality of sheets have been simultaneously fed.

The object of the present invention can be achieved by an apparatus for controlling a sheet supplying device having a feeding device capable of feeding a copying sheet from a plurality of stacked copying sheets in a sheet stacking portion and a reversing device capable of returning copying sheets desired not to be fed at an instance of feeding process includes, an unit for applying a rotational driving force to the feeding device so as to draw a copying sheet out of the stacked copying sheets in the sheet stacking portion by rotating the feeding device in one direction, an unit for applying a rotational driving force to the reversing device so as to return a copying sheet desired not to be fed to the sheet stacking portion at a time when a plurality of copying sheets are simultaneously fed out from the sheet stacking portion by rotating the reversing device in another direction, and an unit for controlling both of the applying units such that the rotational driving force applied to the feeding device is stopped at a time when a copying sheet to be fed has passed on the feeding device and the rotational driving force applied to the reversing device is kept to apply to the reversing device at least for a predetermined time period after stopping to apply the rotational driving force to the feeding device.

Preferably, the applying unit for applying the rotational force to the feeding device is capable of applying a rotational force which is enable to rotate the feeding device in the another direction.

Furthermore, the controlling unit is preferably capable of applying a rotational driving force to the feeding device so as to rotate in the another direction for a constant time period as well as applying a rotational driving force to the reversing device at least for a constant time period after the copying sheet to be fed has passed on the feeding device.

The applying unit to the feeding device may include a gear and a forward-rotation control clutch both of which are disposed at an ending edge of a rotatable shaft of the feeding device so as to switch on/off a transmission of the rotational driving force to the feeding device and to secure a free rotation of the rotatable shaft by stopping a transmission of the rotational driving force, preferably.

The applying unit to the feeding device includes preferably a first gear and a reverse-rotation control clutch both of which are disposed at a leading edge of a rotational shaft of the feeding device for controlling a reverse rotation caused by the first gear, the first gear being engaged to a second gear which is coaxially provided with an idle gear, a third gear is engaged to the second gear, and a fourth gear is engaged to the third gear so as to transmit the rotational driving force to the first gear thereby.

Moreover, the applying unit to the reversing device preferably includes a gear and a rotatable shaft of the reversing device, the gear being secured to an ending edge of the rotatable shaft so as to transmit a rotational driving force to the reversing device.

Preferably, the controlling unit includes a plurality of sheet guides arranged between the feeding device and a conveyance roller for guiding the copying sheet transmitted by the feeding device to the conveyance roller, an idle gear which is engaged to both the gear and a gear disposed at an ending edge of a rotatable shaft of the feeding device, another gear engaged to the idle gear for driving the conveyance roller adapted to transmit the copying sheet to the sheet guides, and a feed sensor disposed between the sheet guides for detecting a passing of the copying sheet transmitted from the feeding device.

The controlling unit further includes a pressure release lever having a L-shape drive member which is interposed between the rotatable shafts, the pressure release lever being adapted to rotate vertically at a shaft thereof such that at a time when the pressure release lever is rotated downwardly, the L-shape drive member holds the rotatable shaft and the reversing device so that the reversing device is separated from the feeding device, preferably.

More preferably, the controlling unit further includes a sheet return plate disposed between a pull-in roller and the feeding device so as to be rotated vertically relative to a shaft disposed upper than a position of a pin of a drive shaft of the sheet return plate for returning a copying sheet toward the sheet stacking portion.

The sheet return plate has a returning member disposed on two sides of the feeding device, the returning member extending close to a tangent line between the feeding device and the reversing device, the returning member acting to push and to return a leading edge of a copying sheet which has been stopped on the tangent line toward a rotatable plate, preferably.

The controlling unit further includes a sheet detection switch and a no-sheet detection switch disposed on two sides of the pull-in roller on a support frame, each of the two detection switches has a drive member respectively so that the two detection switches are operated at a time when the two switches are pushed by a sheet supplying portion of the rotatable plate being lifted.

The rotatable plate preferably has a longitudinal sheet supplying portion and a sideway supplying portion, each of the portions having a cut at a position corresponding to a drive member of the no-sheet detection switch for detecting an existence of no sheet so that the no-sheet detection switch is not turned on and only the sheet detection switch is turned on at a time when there is no copying sheet on the rotatable plate, and both detection switches are turned on at a time when copying sheets are stacked.

Furthermore, the feeding device includes a pull-in roller dispose above a sheet supplying portion of the sheet stacking portion and a feeding device disposed in parallel with the pull in roller, the two rollers being positioned adjacently at a predetermined distance in a supplying direction of a copying sheet from the sheet stacking portion.

Preferably, the two rollers are adapted to rotate in a direction of which an endless belt arranged between ending edges of the two rollers is moving.

The feeding devices further includes a pair of roller arms arranged between a supporting shaft which rotatably supports the pull-in roller and a rotatable shaft for transmitting rotational force to the feeding device, the roller arms being adapted to hold the two rollers, preferably.

The pair of roller arms is preferably adapted to be rotated relative to the rotatable shaft, and the pull-in roller is lifted and/or lowered so that the pull-in roller is brought into contact with/or is separated from the copying sheet.

Moreover, the roller arms are adapted to rotate upwardly at a time when projections formed at ending edges of the roller arms adjacent to the feeding device are pushed downwardly by a sheet supply angle, preferably.

The reversing device preferably is attached to an attachment plate disposed below the feeding device such that at a time when the reversing device rotates in a direction which is the same direction of a rotational direction of the feeding device so as to return the copying sheet which is desired not be fed.

Furthermore, the attachment plate includes two end shafts supported by a sheet guide capable of rotating vertically so that the reversing device presses and/or releases the feeding device.

The attachment plate is preferably urged in a direction in which the reversing device is brought into contact with the feeding device by using a spring.

Preferably, the reversing device is attached to a rotatable shaft which transmits rotational force to the reversing device via a torque limiter, and the rotatable shaft is disposed below a rotatable shaft of the feeding device in parallel with the rotatable shaft, and the rotatable shaft is adapted to exert a driving force to the reversing device so that the rotatable shaft is idled at a time when a resistance acts on the reversing device.

According to the structure of the first aspect of the present invention, if two sheets have been simultaneously and undesirably fed (double feed), either of the sheets if fed to a predetermined conveyance path by the rotation of the feed roller, while the feeding of another sheet into the sheet feeding direction is prevented by the rotation of the reversing roller so that the problem of the double feeding is overcome. Furthermore, since the leading edge of the sheet which must not be fed can be stopped in front of the tangent line between the two rollers, the sheet can be assuredly returned in the case where the structure has a sheet returning plate.

Furthermore, if three sheets have been fed simultaneously and undesirably (triple feed) and the intermediate sheet of the three sheets has stopped at a position exceeding the roller tangent line, supply of driving force to the feed roller is stopped after the sheet to be fed has passed through the feed roller. Furthermore, the driving force is supplied to the reversing roller for a predetermined time even after the operation of the feed roller has been stopped. Therefore, the above-described intermediate sheet can be returned to the sheet cassette and the leading edge of the sheet can be positioned in front of the tangent line of the rollers.

Furthermore, even if the feeding of the sheet which must not be fed has not been stopped and the sheet has been stopped at a position exceeding the roller tangent line in the case where two sheets have been fed simultaneously and undesirably, the sheet can be assuredly returned.

A structure may be employed in which the driving force is always given the reversing roller.

According to the second aspect of the present invention, reversed-directional driving force is supplied to the sheet feeding roller for a predetermined time after the sheet to be fed has passed through the sheet feeding roller. Therefore, the feed roller acts to assist the returning of the sheet so that the returning of the sheet can be further assuredly conducted.

Further objects and advantages of the present invention will be apparent from the following description, reference being had to the accompanying drawings wherein preferred embodiments of the present invention are clearly shown.

DESCRIPTION OF THE PREFERRED EMBODIMENTS

Preferred embodiments of the present invention will now be described with reference to the drawings.

Figure 1:
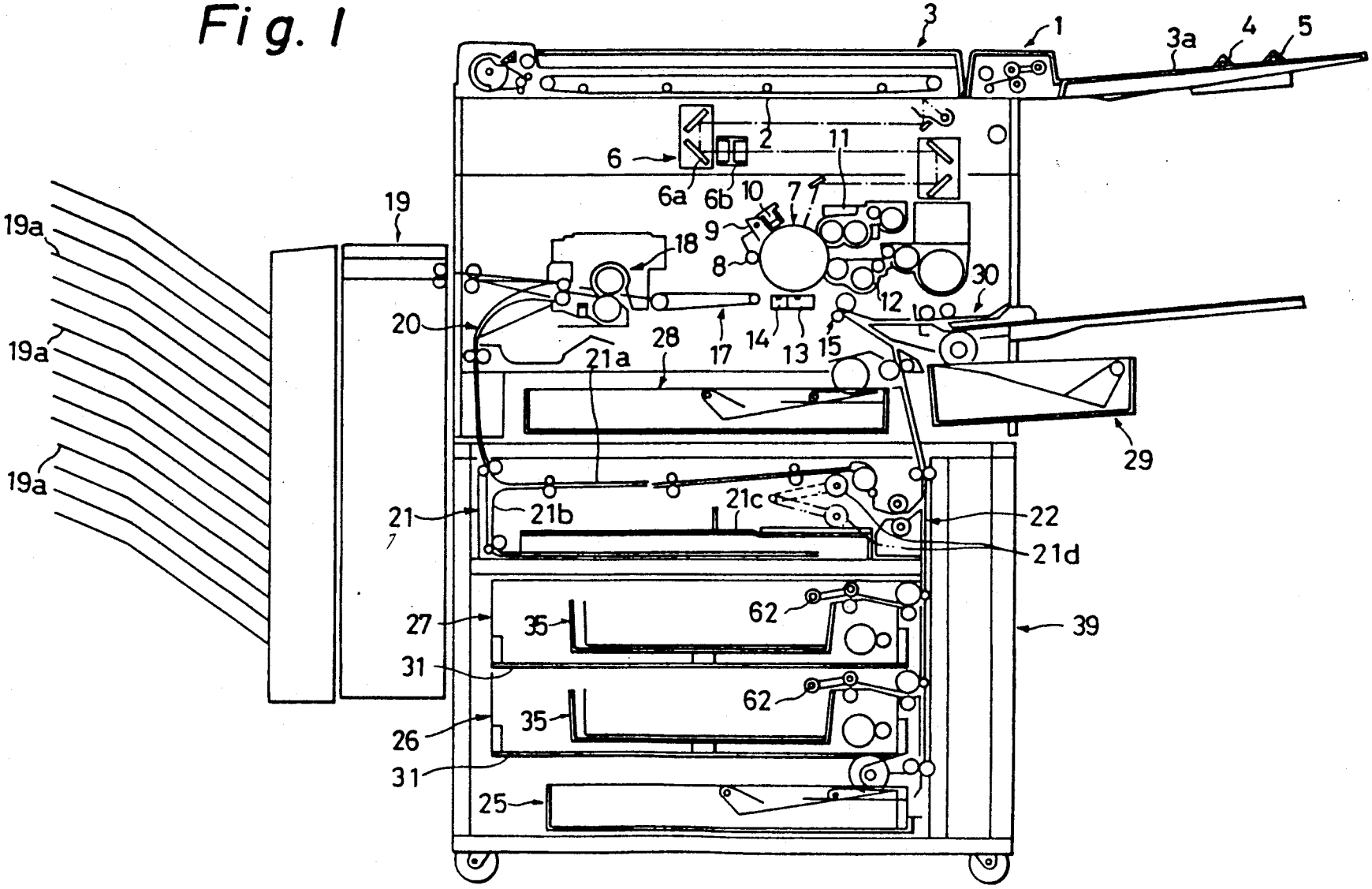
FIG. 1 illustrates the schematic internal mechanism of a copying machine according to an embodiment of the present invention.

FIG. 1 is a front elevational view which illustrates the schematic structure relating to a copying machine 1 arranged to employ a method and an apparatus for controlling a sheet supplying device according to an embodiment of the present invention.

As shown in FIG. 1, an automatic document feeder (to be called "an ADF" hereinafter) 3 is disposed on a document platen glass 2 of a copying machine 1. The ADF 3 has a function of feeding a document (omitted from illustration) placed on a document tray 3*a* to a predetermined position on the document platen glass 2 determined in accordance with the size or the feeding direction (the sideway feeding or the longitudinal feeding direction) of the document and discharging the document outside the ADF 3 after the copying operation has been completed. Furthermore, the ADF 3 has another function acting in the case where a double sided copying is performed such as turning out the document, then feeding the document to the predetermined position on the document platen glass 2 once more and discharging the document outside the ADF 3 after the copying operation has been completed. The document tray 3*a* has switches 4 and 5 provided for detecting the size of the document placed thereon.

An optical system 6 including reflecting mirrors 6*a* and lenses 6*b* which are disposed below the document platen glass 2. The optical system 6 has a basic function of introducing light reflected by the document to a photoconductor drum 7 and a magnification varying function of performing the equal magnification copying as well as the enlarged-magnification copying and the reduced-magnification copying.

A cleaner 8, a discharger 9, a charger 10, a developer 11 including color-copying toner and another developer 12 including black toner are all disposed around the photoconductor drum 7. As a result, the photoconductor drum 7 can be subjected to a series of processes including the processes of removing the remained toner, the discharging, the charging, the exposing (performed by the above-described optical system) and the developing.

A transfer charger 13 and a separating charger 14 are disposed below the photoconductor drum 7 so that a toner image formed on the photoconductor drum 7 is, by the transfer charger 13, transferred to a copying sheet when the copying sheet passes between the photoconductor drum 7 and the transfer charger 13. Furthermore, the copying sheet is separated from the photoconductor drum 7 by the separating charger 14, and the separated copying sheet is arranged to be sent to a fuser 18 by a feed belt 17. The fuser 18 is provided for fusing the toner transcribed to the copying paper sheet due to heat or pressure.

The copying paper sheet which has passed through the fuser 18 is basically discharged outside the copying machine 1, that is, it passes through a sorter 19 and is then discharged to a sheet receiver 19*a* of the sorter 19. However, in the case where, for example, the double side copying or the synthesis copying is performed, the copying sheet passes through a sheet return path 20 before it is introduced into a double side synthesis unit 21. When the double side copying is performed, the copying sheet is turned out and placed on an intermediate tray 21c after it has passed through a first sheet path 21 a formed in the double side synthesis unit 21. Then, it is sent to a sheet supply path 22 by a feed-out roller 21d. When the synthesis copying is performed, the copying sheet is sent to a second sheet path 21b formed in the double side synthesis unit 21 so that the ending edge of the copying sheet is detected in the second sheet path 21b. Then, the ending edge of the copying sheet is made the leading edge of the forward movement of the copying sheet, and the thus arranged copying sheet is sent to pass through the above-described first sheet path 21a before it is turned out and placed on the intermediate tray 21c. Then, it is sent to the sheet supply path 22 by the feed-out roller 21d.

The above-described sheet supply path 22 acts to introduce the copying sheet into the above-described photoconductor drum 7, and the sheet supply path 22 has, at its ending edge, a paper stop roller 15 for causing the rotation of the photoconductor drum 7 and for preforming the copying sheet sending motion timely.

A sheet stacking portion in the form of several steps in a desk 39 is connected to the sheet supply path 22. Thus, a copying sheet is properly supplied by the sheet stacking portion. Specifically, a first fixed cassette 25, a first rotatable cassette unit 26, a second rotatable cassette unit 27, the above-described synthesis unit 21, a second fixed cassette 28, a third fixed cassette 29 and a manual sheet supply portion 30 are all provided when viewed from the lower portion of the copying machine 1. The above-described first fixed cassette 25, the second fixed cassette 28 and the third fixed cassette 29 are arranged to be detachable with respect to the copying machine 1. On the other hand, the first rotatable cassette unit 26 and the second rotatable cassette unit 27 can be drawn from the copying machine 1 with a support plate 31.

Figure 2:
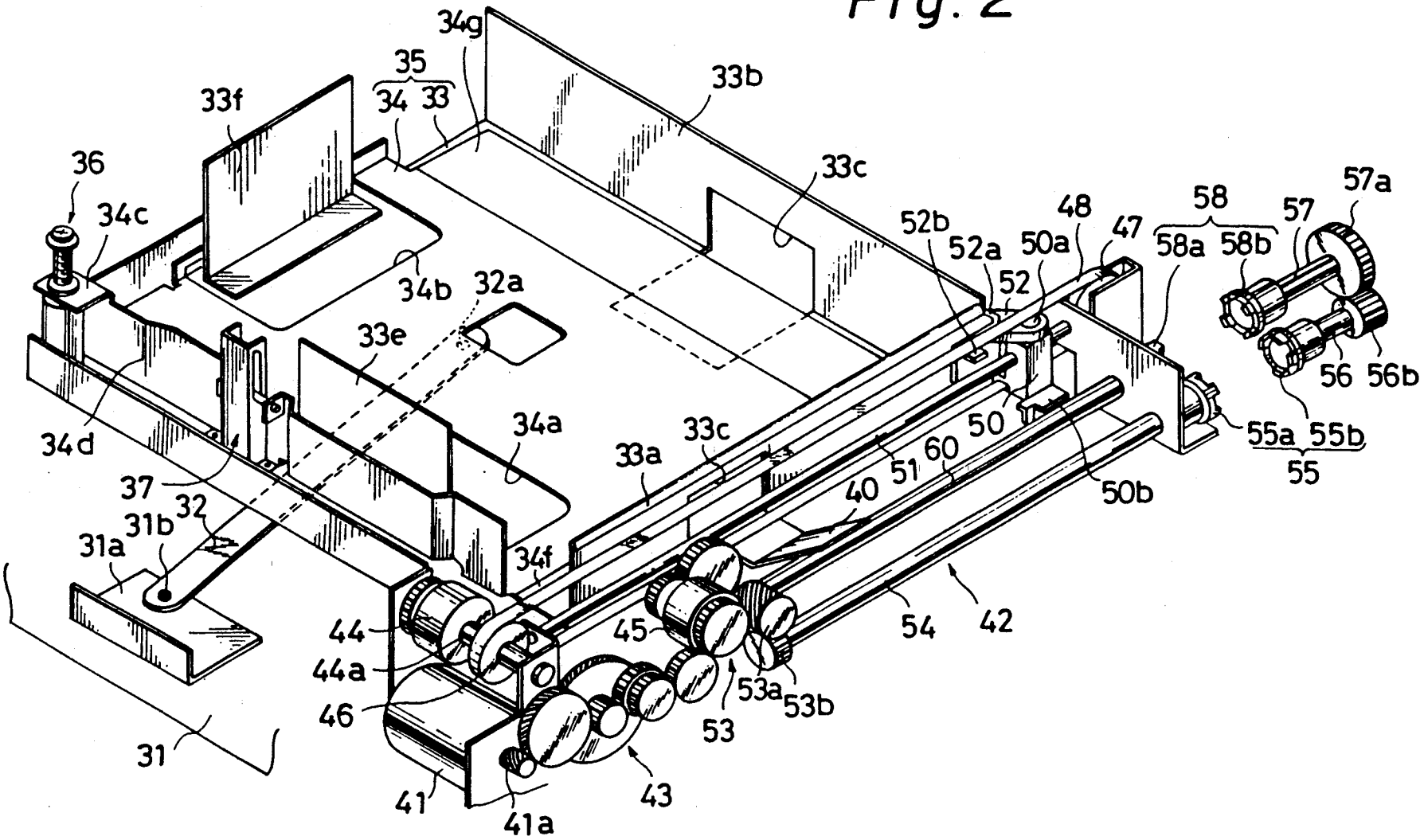
FIG. 2 illustrates the structure of a rotary cassette unit according to the embodiment of the present invention.

Now, the first and the second rotatable cassette units 26 and 27 will be described in detail with reference to FIG. 2. The first and second rotatable cassette units 26 and 27 are arranged such that a support seat 31a is secured onto the support plate 31 which is serving as a housing for the first and the second rotatable cassette units 26 and 27. Furthermore, an end portion of an arm 32 is pivotally supported by a supporting shaft 31b which is erected on the support seat 31a. As a result, the arm 32 is supported such that it can horizontally rotate around the supporting shaft 31b. Another supporting shaft 32a is erected at another end portion of the arm 32, and the supporting shaft 32a is rotatably supporting a rotatable cassette 35. The rotatable cassette 35 includes two plates which are a sheet supply base 33 and a rotatable plate 34 positioned on the sheet supply base 33 so that the supplying of each of the copying paper sheets stacked on the rotatable plate 34 can be optionally switched to either the longitudinal supplying or the sideway supplying by rotating the rotatable cassette 35 by 90°. In both the longitudinal sheet supplying and lateral sheet supplying operations, the position at which the rotatable cassette 35 is rotatably supported by the supporting shaft 32a is determined such that the center of the copying paper sheet being fed is passing through the supporting shaft 32a.

A wall portions 33a and 33b are, with bent, formed in a longitudinal sheet supplying portion and a sideway sheet supplying portion in the sheet supply base 33 for the purpose of preventing a deviation of the stacked copying sheets. Each of the wall portions 33a and 33b has a cut 33c at its substantial center portion. Each of the cuts 33c reaches the bottom plate of the sheet supply base 33 and it further formed deeply by a predetermined length toward the central portion of the bottom plate of the sheet supply base 33. As a result, a lift plate 40 disposed below the sheet supply base 33 can be brought into contact with the reverse surface of the bottom plate of the rotatable plate 34. The specific structure of the lift plate 40 will be described later.

On the sheet supply base 33, there are provided wall portions 33e and 33f at positions corresponding to the above-described wall portion 33a and 33b. These wall portions 33e and 33f are formed such that they pass through corresponding cuts 34a and 34b formed in the rotatable plate 34. As a result, the lifting operation performed in the longitudinal sheet supplying portion and the sideway sheet supplying portion in the rotatable plate 34 cannot be hindered by the wall portions 33e and 33f.

On the rotatable plate 34, there are provided a slanted portion 34f which is forwards and downwards slanted in the longitudinal sheet supplying portion and a slanted portion 34g which is forwards and downwards slanted in the sideway sheet supplying portion.

A supporting member 34c extending over the upper end portion of the wall portion 34d of the rotatable plate 34 and formed in a bent shape is disposed in a corner portion between the non-sheet supply portion of the longitudinal sheet supplying portion and that of the sideway sheet supplying portion is the rotatable plate 34. The supporting member 34c has a supporting structure 36 which supports the rotatable plate 34 at one point of the rotatable plate 34.

A guide member 37 is disposed at a position in the non-sheet supply side of the rotatable cassette 35, the position being away from the supporting structure by a certain distance. The guide member 37 guides the rotatable plate 34 at the time of the lifting operation in the longitudinal sheet supplying portion in the rotatable plate 34, while it serves as a rotation pivot of the rotation of the rotatable plate 34 at the time of the lifting operation in the sideway sheet supplying portion in the rotatable plate 34.

A drive mechanism 42 is provided at the supplying portion of the rotatable cassette unit 26 (27) for causing a drive motor 41 thereof to perform both the 90°-rotational operation of the rotatable cassette 45 and the rotational operation of the lift plate 40 for the sheet lifting motion of the rotatable plate 34. The drive mechanism 42 is arranged such that a gear 41a is secured to the output shaft of the drive motor 41 so that the driving force of the drive motor 41 is transmitted to first and second clutches 44 and 45 via a gear group 43 engaged to the gear 41a.

The first clutch 44, disposed in the side portion of the sheet supplying portion of the rotatable cassette 35, switches on/off the transmission of the driving force necessary for the 90°-rotation of the rotatable cassette 35. A pulley 46 is secured to an output shaft 44a of the first clutch 44, while another pulley 47 is disposed in the other side portion of the sheet supplying portion of the rotatable cassette 35. An endless belt 48 is arranged between the above-described two pulleys 46 and 47. A moving block 50 is secured at a predetermined position of the belt 48 below the two pulleys 46 and 47 so that the moving block 50 reciprocates in synchronization with the operation of the belt 48. A guide shaft 51 laid perpendicularly to the sheet supplying direction and between the above-described two pulleys 46 and 47 is inserted into a through hole formed at the substantially central portion of the moving block 50. The guide shaft 51 enables the moving block 50 to be linearly guided. A support shaft 50*a* is formed in the upper portion of the moving block 50, and a holding member 52 is rotatably supported by the support shaft 50*a*. The holding member 52 has a substantially L-shape angle portion 52*a* formed thereto, and the angle portion 52*a* is disposed at the corner portion between the longitudinal sheet supplying portion and the sideway sheet supplying portion in the sheet supply base 33.

The second clutch 45 acts to switch on/off the transmission of the driving force necessary for the sheet lifting motion of the rotatable plate 34. The output of the second clutch 45 is arranged to be transmitted to a rotatable shaft 54 via a gear group 53. That is, the output of the second clutch 45 is transmitted from each of gears of the gear group 53 to a worm gear 53*a*, and then it is transmitted to the rotatable shaft 54 which is formed in a grade separation manner with respect to the output shaft of the second clutch 45 via a wheel gear 53*b* which is engaged to the above-described worm gear 53*a*.

A joint member 55*a* forming a first coupling 55 is secured to another ending edge of the rotatable shaft 54, while another joint member 55*b* forming the first coupling 55 is secured to the leading edge of a rotatable shaft 56 which is rotatably supported at the body of the copying machine 1. A gear 57*a* secured to a rotatable shaft 57 is engaged to a gear 56*b* secured to the rotatable shaft 56. The rotatable shaft 57 is rotatably fastened adjacent to the body of the copying machine 1 in parallel with the above-described rotatable shaft 56 and similarly to this above-described rotatable shaft 56. A joint member 58*b* forming a second coupling 58 is secured to the leading edge of the rotatable shaft 57. A joint member 58*a* forming the second coupling 58 is secured to an ending edge of a lift-up shaft 60 provided in parallel with the above-described rotatable shaft 54. The engagement and release between the joint members 55*a* and 55*b* of the first coupling 55 and between the joint members 58*a* and 58*b* of the second coupling 58 are enabled by the loading and drawing of the rotatable cassette unit 26 (27) from the copying machine 1.

The lift plate 40 is secured to a substantially central portion of the lift-up shaft 60 so that the lift plate 40 is rotated by the rotation of the lift-up shaft 60 and the sheet supplying portion of the rotatable plate 34 is thereby lifted. Another ending edge of the lift-up shaft 60 is merely rotatably supported and no element is connected thereto.

Figure 3:
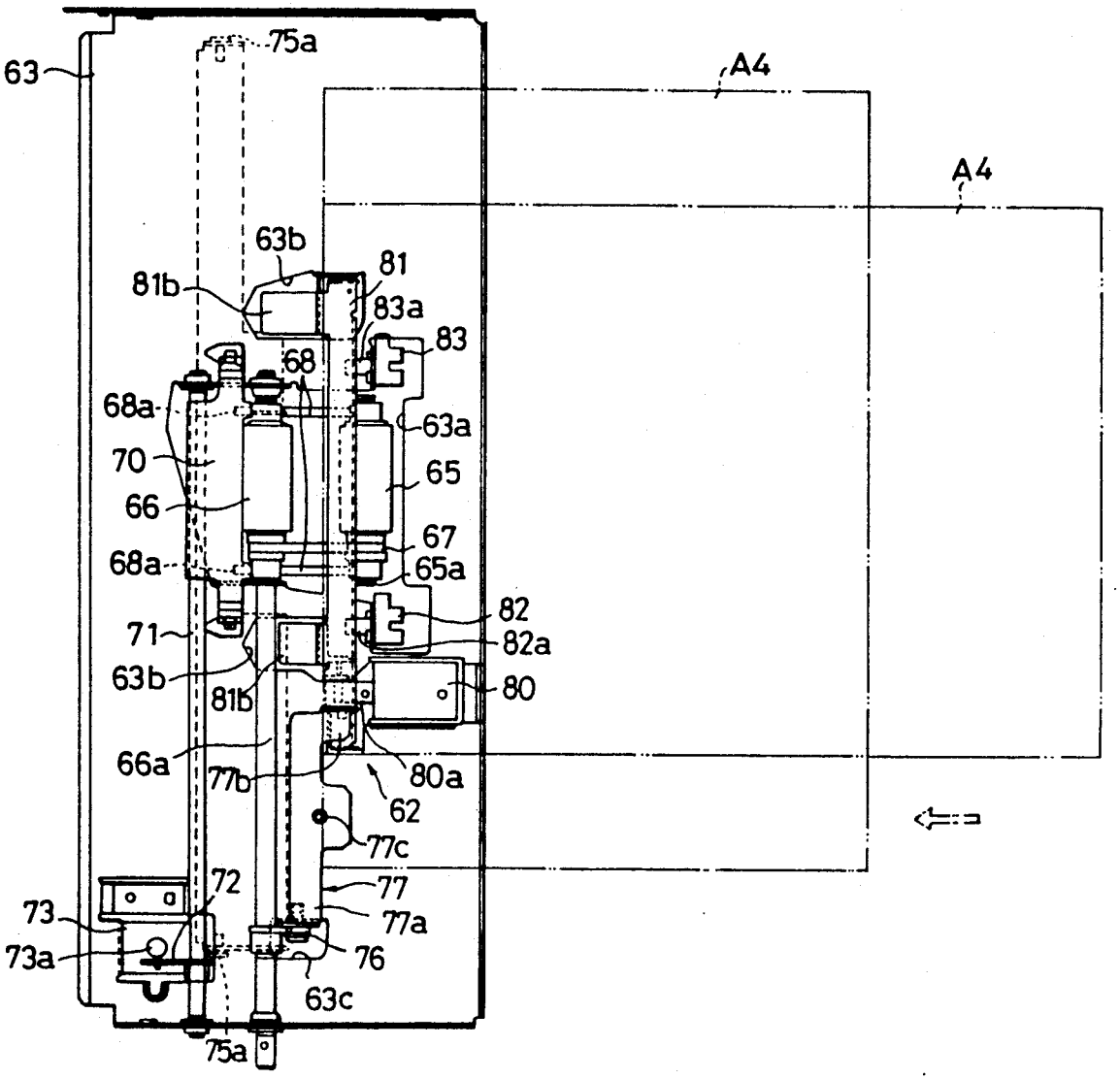
FIG. 3 illustrates the structure of a sheet feeder according to the embodiment of the present invention.

As shown in FIG. 3, a support frame 63 is secured above the sheet supplying portion of the rotatable cassette 35 at a position adjacent to the body of the copying machine 1. A sheet supply mechanism 62 for supplying the copying sheet to the sheet supply path 22 is provided for the support frame 63. The support frame 63 has a cut 63*a* through which a portion of each of an pull-in roller 65 and a feed roller 66 projects downwards over the support frame 63, a cut 63*b* through which a portion of a sheet return plate, 81 projects downwards over the support frame 63 and a cut 63*c* through which a portion of a pressure release lever 76 projects downwards over the support frame 63.

In the above-described sheet supply mechanism 62, the pull in roller 65 is disposed above the sheet supplying portion of the rotatable cassette 35, while, the feed roller 66 is disposed in parallel with the pull-in roller 65, and the two rollers 65 and 66 are positioned adjacently at a predetermined distance in the copying sheet supplying direction. The two rollers 65 and 66 are arranged to be rotated in the same direction by an endless belt 67 arranged between ending edges of the two rollers 65 and 66. A pair of roller arms 68 is arranged between a support shaft 65*a* which rotatably supports the pull-in roller 65 and a rotatable shaft 66*a* for transmitting rotational force to the feed roller 66, and the roller arms 68 are arranged to hold the two rollers 65 and 66. When the above-described roller arms 68 rotate relative to the rotatable shaft 66*a*, the pull-in roller 65 is lifted and/or lowered so that the pull-in roller 65 is brought into contact with the copying sheet or the pull-in roller 65 is separated from the copying sheet.

Projections 68*a* are respectively formed at the ending edges of the roller arms 68 adjacent to the feed roller 66. When the projections 68*a* are pushed downwards by a sheet supply angle 70, the roller arms 68 can be rotated upwards. A spring 79 is disposed between the sheet supply angle 70 and the support frame 63, the spring 79 urging the sheet supply angle 70 in a direction in which the projections 68*a* are pressed. The sheet supply angle 70 is secured to an ending edge of a sheet supply shaft 71, and is rotated by the rotation of the sheet supply shaft 71.

A solenoid connection plate 72 is secured to another ending edge of the sheet supply shaft 71. The drive shaft 73*a* of the solenoid 73 is connected to an elongated hole formed at the leading edge of the solenoid connection hole 72. Therefore, the forward and backward movement of the drive shaft 73*a* is converted into the rotational operation of the sheet supply shaft 71 via the solenoid connection plate 72.

Figure 4A:
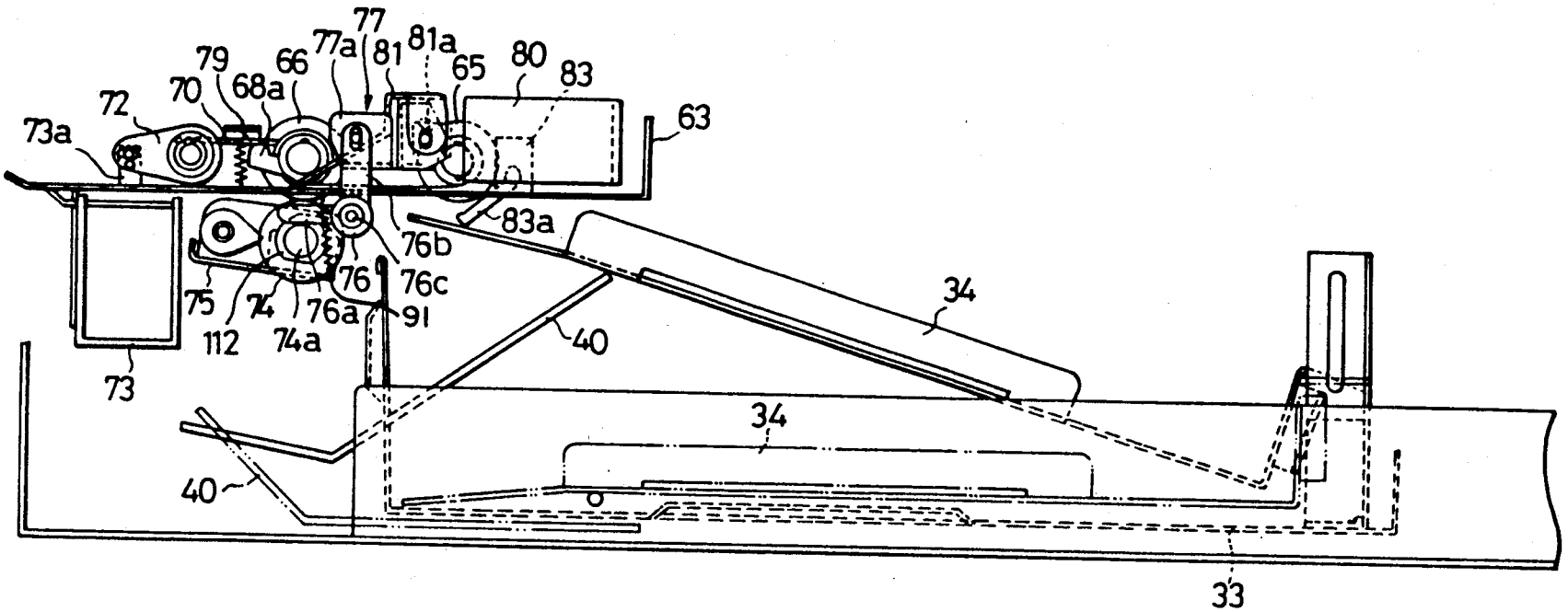
FIG. 4*a* is a side elevational view of the sheet feeder shown in FIG. 3.
Figure 4B:
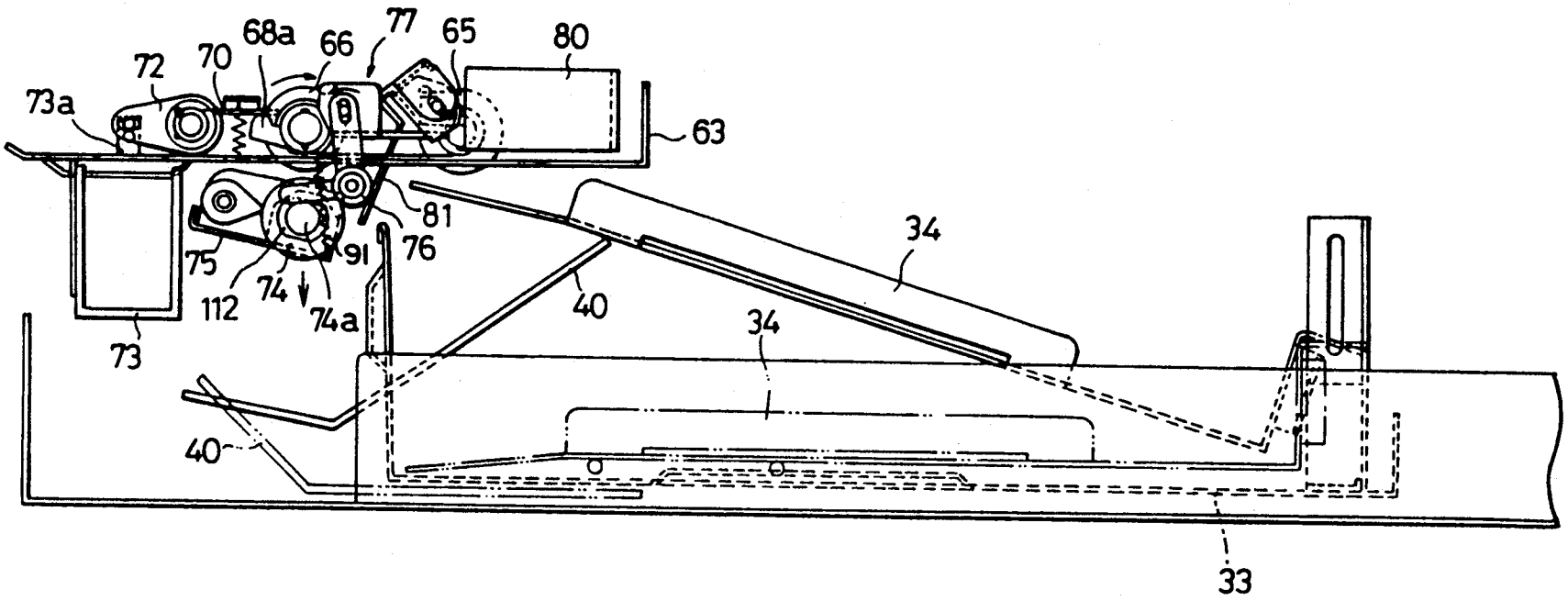
FIG. 4*b* illustrates a state where a sheet returning plate of the sheet feeder shown in FIG. 4*a* has been rotated.

As shown in FIGS. 4*a* and 4*b*, an attachment plate 75 is disposed below the feed roller 66. A reverse roller 74, which rotates in the same direction (clockwise when viewed in FIGS. 4*a* and 4*b*) as the rotational direction of the feed roller 66 so as to return the copying sheet, is attached to the attachment plate 75. The attachment plate 75 has two end shafts 75*a* (shown in FIG. 3) supported by a sheet guide such that it can rotate vertically. As a result of this rotation, the reverse roller 74 presses the feed roller 66 and releases the feed roller 66. The attachment plate 75 is, by a spring 91, one end of the spring 91 being attached to the support frame 63, and the other end of the spring 91 being attached to the attachment plate 75 of the reverse roller 74, thereby it urged in a direction in which the reverse roller 74 is brought into contact with the feed roller 66. The reverse roller 74 is attached to a rotatable shaft 74*a* which transmits rotational force to the reverse roller 74 via a spring frictional member (a torque limiter) 112 (shown in FIGS. 5*a*, 5*b* and 5*c*). If a resistance, which is due to the rotation and exceeding a certain level, acts on the reverse roller 74, the transmission of the driving force of the rotatable shaft 74*a* to the reverse roller 74 is stopped so as to have the rotatable shaft 74*a* idled. The rotatable shaft 74*a* is disposed below the rotatable shaft 66*a* of the above-described feed roller 66 in parallel with the rotatable shaft 66*a*.

Figure 6:
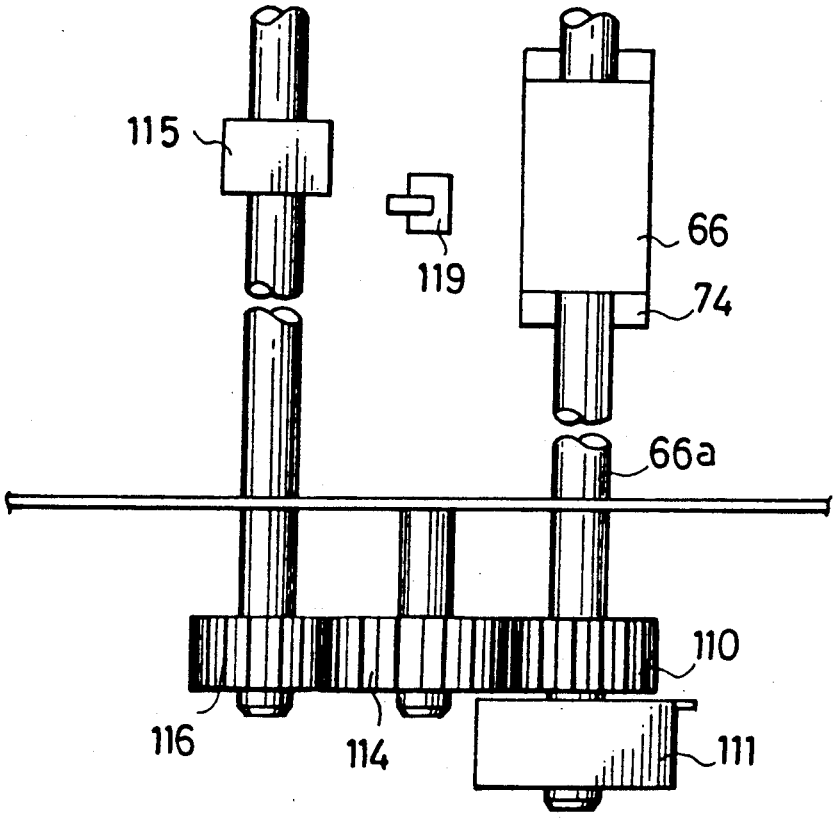
FIG. 6 is a plan view which illustrates an essential portion of the sheet feeder shown in FIG. 3.
Figure 7:
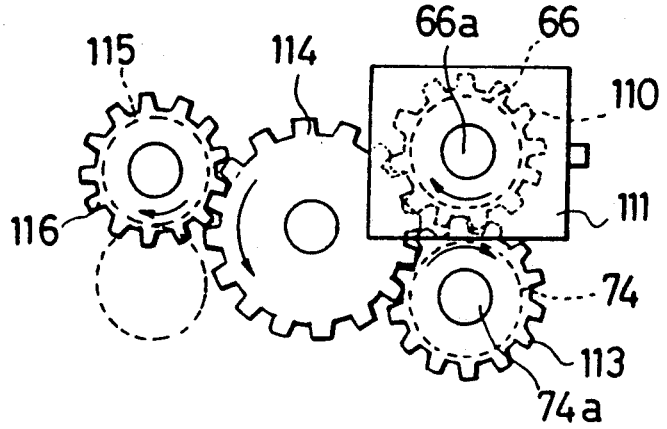
FIG. 7 is a side elevational view which illustrates the sheet feeder shown in FIG. 3.

A driving system for rotating the feed roller 66 and a driving system for rotating the reverse roller 74 will be described with reference to FIGS. 6 and 7. A gear 110 and a forward-rotation control clutch 111 are disposed at an ending edge of the rotatable shaft 66*a*. The gear 110, the forward-rotation control clutch 111 and the rotatable shaft 66*a* constitute a driving system which switches on/off the transmission of the rotational force to the feed roller 66 and secure the free rotation of the rotatable shaft 66*a* by stopping the transmission of the rotational force. A gear 113 is secured to an ending edge of the rotatable shaft 74*a*.

The gear 113 and the rotatable shaft 74*a* constitute a driving system which transmits the rotational force to the reverse roller 74. An idle gear 114 is engaged to the gears 110 and 113, and a gear 116 for driving a conveyance roller 115 is engaged to the idle gear 114. As shown in FIG. 2, sheet guides 117 and 118 are arranged between the feed roller 66 and the conveyance roller 115, and a feed sensor 119 for detecting the passing of the copying sheet is disposed between the sheet guides 117 and 118.

Assuming that friction coefficient between the feed roller 66 and the copying sheet is $\mu 1$, friction coefficient between the reverse roller 74 and the copying sheet is $\mu 2$, friction coefficient between the feed roller 66 and the reverse roller 74 is $\mu 3$, friction coefficient between the copying sheets is $\mu 4$, pressing force between the feed roller 66 and the reverse roller 74 is F1, the diameter of the reverse roller 74 is d, the idle torque of the feed roller 66 at the time of the free rotation is T1 (the torque on the circumference of the roller) and the torque of the spring frictional member of the reverse roller 74 is T2 (the torque on the circumference of the roller), the structure is arranged so as to meet the following Equations (1) to (4):

$$\mu 3 > \mu 1 > \mu 2 > \mu 4 \quad (1)$$

$$\mu 2\ F1d/2 > T2 \quad (2)$$

$$T2 > T1 \quad (3)$$

$$\mu 1\ F1d/2 > T1 \quad (4)$$

A substantially L-shape drive member 76*a* of the pressure release lever 76 is interposed between the above-described rotatable shafts 66*a* and 74*a*. The pressure release lever 76 is enable to rotate vertically at its shaft 76*c*. When it is rotated downwards, the above-described driving member 76 is caused to hold the rotatable shaft 74*a* and the reverse roller 74. As a result, the reverse roller 74 is separated from the feed roller 66. A connection member 76*b* of the pressure release lever 76 is connected to an ending edge 77*a* of a pressure release connection member 77. When the pressure release connection member 77 is rotated horizontally relative to a shaft 77*c* (shown in FIG. 3), the pressure release lever 76 is rotated. Another ending edge 77*b* of the pressure release connection member 77 is connected to a pin of a drive shaft 80*a* of a sheet return solenoid 80. When the drive shaft 80*a* moves forward and backward, the pressure release connection member 77 is rotated.

A sheet return plate 81 for returning the copying sheet toward the rotatable cassette 35 is connected to the drive shaft 80*a* of the sheet returning solenoid 80. The sheet return plate 81 is disposed between the pull-in roller 65 and the feed roller 66 so as to be rotated vertically relative to a shaft 81*a* disposed upper than the position of the pin of the above-described drive shaft 80*a*. The sheet return plate 81 has returning members 81*b* disposed on the two sides of the feed roller 66 and extending close to a tangent line between the feed roller 66 and the reverse roller 74, and returning members 81*b* is acting to push and return the leading edge of the copying sheet which has been stopped on the tangent line between the feed roller 66 and the reverse roller 74 toward the rotatable plate 34.

A sheet detection switch 82 and a no-sheet detection switch 83 are provided on the two sides of the pull-in roller 65 on the support frame 63. The switches 82 and 83 have corresponding drive members 82*a* and 83*a* so arranged that they confront the portions below the support frame 63 via the cut 63*a* formed in the support frame 63. The drive members 82*a* and 83*a* of the switches 82 and 83 are arranged to be operated when they are pushed by the sheet supplying portion of the rotatable plate 34 which is being lifted. Each of the longitudinal sheet supplying portion and the sideway sheet supplying portion of the rotatable plate 34 has a cut (omitted from illustration) at a position corresponding to the drive member 83*a* of the no-sheet detection switch 83 for detecting the existence of no sheet. Therefore, when there is no copying sheet on the rotatable plate 34, the drive member 83*a* passes through the above-described cut so that the detection switch 83 is not switched on and only the sheet detection switch 82 is switched on. When the copying sheets are stacked, both detection switches 82 and 83 are switched on by the stacked copying sheets.

The operation of lifting the sheet supplying portion of the rotatable plate 34 and a sheet supplying operation performed by the sheet supply mechanism 62 will now be described. When the second clutch 45 is operated, the driving force of the drive motor 41 is transmitted to the lift-up shaft 60 via the gear group 53, the rotatable shaft 54, the first coupling 55, the rotatable shaft 56, the rotatable shaft 57 and the second coupling 58. Thus, the lift-up shaft 60 is rotated, and causing the lift plate 40 to be rotated. When the lift plate 40 is upwardly rotated, the lift plate 40 is brought into contact with the bottom surface of the rotatable plate 34 after it has passed through the cut 33*c* formed in the sheet supply base 33. As a result, the sheet supplying portion of the rotatable plate 34 is lifted, and the introduction of the copying sheet by the sheet supply mechanism 62 is enabled.

In response to a sheet supply signal supplied from the control portion of the copying machine 1, the sheet supply solenoid 73 is operated. As a result, the sheet supply angle 70 is upwardly rotated via the solenoid connection plate 72 and the sheet supply shaft 71. The roller arms 68, the abutment of which against the projections 68*a* has been released, are lowered by the rotational force of the belt 67, and the pull-in roller 65 is thereby lowered. When the pull-in roller 65 is rotated, the uppermost copying sheet placed on the rotatable plate 34 is introduced onto the tangent line between the feed roller 66 and the reverse roller 74. The sheet introduction operation (in a lowered state) performed by the pull-in roller 65 is continued during a predetermined time period in which the sheet supply solenoid 73 operates or until the thus fed sheet is detected on a predetermined path. Although the pull-in roller 65 does not perform the sheet introduction operation (in a lifted state), the pull-in roller 65 is rotated since the above-described feed roller 66 is rotated.

Figure 5A:
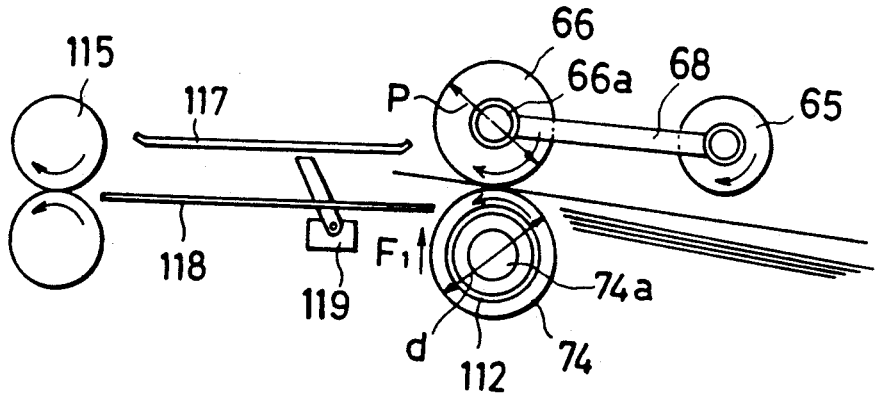
FIG. 5*a* illustrates a state where only one sheet has been conveyed in the sheet feeder shown in FIG. 3.

When the sheet is introduced one by one, the relationship $\mu 1\ F1d > \mu 2\ F1$ can be held, causing the copying sheet to be conveyed in the sheet supply direction as shown in FIG. 5*a*. Since $\mu 1\ F1d/2 > T2$ is held according to Equation (2), the reverse roller 74 is given drive force from its drive system. However, the reverse roller 74 rotates in the sheet supplying direction in accordance with the conveyance of the copying sheet due to the sliding action of the frictional member 112.

Figure 5B:
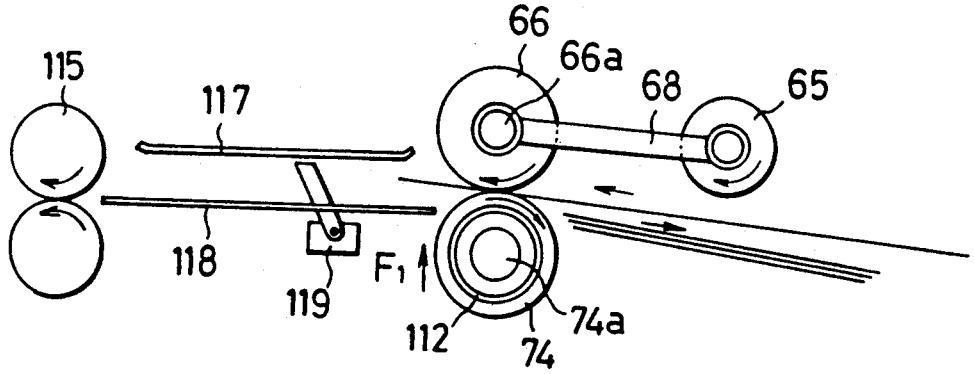
FIG. 5*b* illustrates a state where the sheet to be fed is fed and the feeding of the sheet which must not be fed is prevented in the case where two or more sheets have been simultaneously and undesirably introduced into the sheet feeder shown in FIG. 3.

If two copying sheets are simultaneously and undesirably fed (double feed), the upper copying paper sheet is fed in the sheet supplying direction as shown in FIG. 5*b* since the setting has been made as $\mu 1$ F1d$>\mu 4$ F1. Furthermore since $\mu 2$ F1$>\mu 4$ F1 and $\mu 4$ F1d/2$<$T2, the reverse roller 74 rotates in the direction in which the copying sheet is returned so that the supplying of the lower paper sheet is prevented.

Figure 5C:
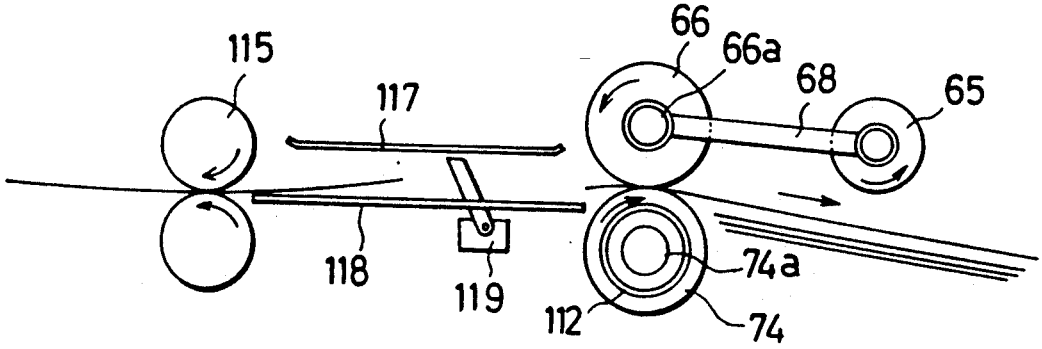
FIG. 5*c* illustrates a state where the sheet to be fed is fed and the sheet which must not be fed is returned in the case where two or more sheets have been simultaneously and undesirably introduced into the sheet feeder shown in FIG. 3.

If three copying sheets are simultaneously and undesirably fed (triple feed), the upper copying sheet is similarly fed in the sheet supplying direction, and the supplying of the lower copying sheet is prevented. After the passing of the upper copying sheet, which is the copying sheet to be fed, above the feed roller 66 has been detected by the above-described sheet supply sensor 119, the transmission of the rotational force to the feed roller 66 is stopped by the above-described clutch 111 so that the feed roller 66 can be freely rotated. Since the rotational force is transmitted to the rotatable roller 74 for a predetermined time even after the transmission of the driving force to the feed roller 66 has been stopped, the intermediate copying sheet, which is the copying sheet not to be fed and which is stopped exceeding the roller tangent line, as shown in FIG. 5*c*, is fed to the reverse roller 74 and it is thereby returned. Since the setting has been made that T2$>$T1 and $\mu 1$ F1d/2$>$T1, the feed roller 66 is also rotated in the direction in which the copying sheet is returned so that sheet returning can be performed smoothly.

Furthermore, not only in the above-described triple feeding but also in the double feeding and where the copying sheet to be fed passes through the feed roller 66 until it is caught between the feed roller 66 and the reverse roller 74, this copying sheet can be assuredly returned due to the continued rotation of the reverse roller 74.

After the copying sheet has been returned completely, the leading edge of the copying sheet is positioned in front of the position on the tangent line between the feed roller 66 and the reverse roller 74. As a result, the feed roller 66 and the reverse roller 74 are brought into contact with each other. In this case, since $\mu 3$ F1d/2$>$T1, the feed roller 66 rotates in the direction in which the copying sheet is returned.

In the case of a single supplying, a sheet-return signal is transmitted from the control portion whenever the supplying of one sheet of the copying sheets has been completed. In the case of a multiple supplying, the sheet-return signal is transmitted from the control portion whenever the supplying of a predetermined number of sheets have been completed. In response to the above-described signal, the rotation of the reverse roller 74 is stopped and simultaneously the sheet return solenoid 80 is operated, causing its drive shaft 80*a* to be retracted.

When the drive shaft 80*a* of the sheet return solenoid 80 is retracted, the abutment release connection member 77 rotates clockwise when viewed in the drawing. As a result of the above-described rotation, the abutment release lever 76 which is connected to an ending edge 77*a* is rotated downwards. Therefore, the reverse roller 74 is separated from the feed roller 66 by the drive member 76*a* of the abutment release lever 76.

Simultaneously with the above-described operation performed by the abutment release lever 76, the sheet return plate 81 rotates counterclockwise relative to a shaft 81*a* disposed higher than the position of the pin of the drive shaft 80*a* due to the retracting operation of the above-described drive shaft 80*a*.

The leading edge of the copying sheet, the supplying of which has been prevented for the purpose of preventing the double feeding and left in front of the tangent line between the feed roller 66 and the reverse roller 74, is pushed by the return members 81*b* due to the downward rotation of the sheet return plate 81 so that it is pushed and returned toward the rotatable plate 34.

As a result, even if the rotatable cassette 35 is rotated after the sheet supplying operation has been completed, damage of the copying sheet due to the above-described rotation can be perfectly prevented since the copying sheet has been completely accommodated in the rotatable plate 34. Therefore, a problem, in that the copying sheet cannot be fed due to the supply of the damaged sheet at the time of the rotation after the sheet supplying has been completed, can be prevented.

According to this embodiment, the description has been made about the rotatable cassette unit, but the present invention is not limited to the above-made description. The present invention can be applied to a fixed cassette which cannot be rotated. According to this embodiment, the above described structure is arranged such that the reverse roller 74 is separated from the feed roller 66 by the abutment release lever 76. However, the above-described separation of the reverse roller 74 is not the critical element of the present invention. That is, in the case of a structure so arranged that the feed roller 66 and the reverse roller 74 are operated by the same drive system and the stop of the feed roller 66 thereby causes the reverse roller 74 to be stopped, the separation of the reverse roller 74 becomes necessary to prevent the leading edge of the copying sheet from being caught between the two rollers 66 and 74. However, according to this embodiment, the pushing and returning of the copying sheet performed by the sheet return plate 81 is assuredly conducted by using the above-described abutment release lever 76 further. Therefore, the above-described problem cannot take place according to the present invention.

Although the description has been made such that the rotational force must be applied to the reverse roller 74 for at least a predetermined time period and it is applied for a predetermined time period according to the present invention, the present invention is not limited to this description. It may be always applied to the reverse roller 74.

Then, another embodiment of the present invention will now be described. The elements having the same functions as those according to the above-described embodiment are given the same reference numerals and their description is omitted.

Figure 8:
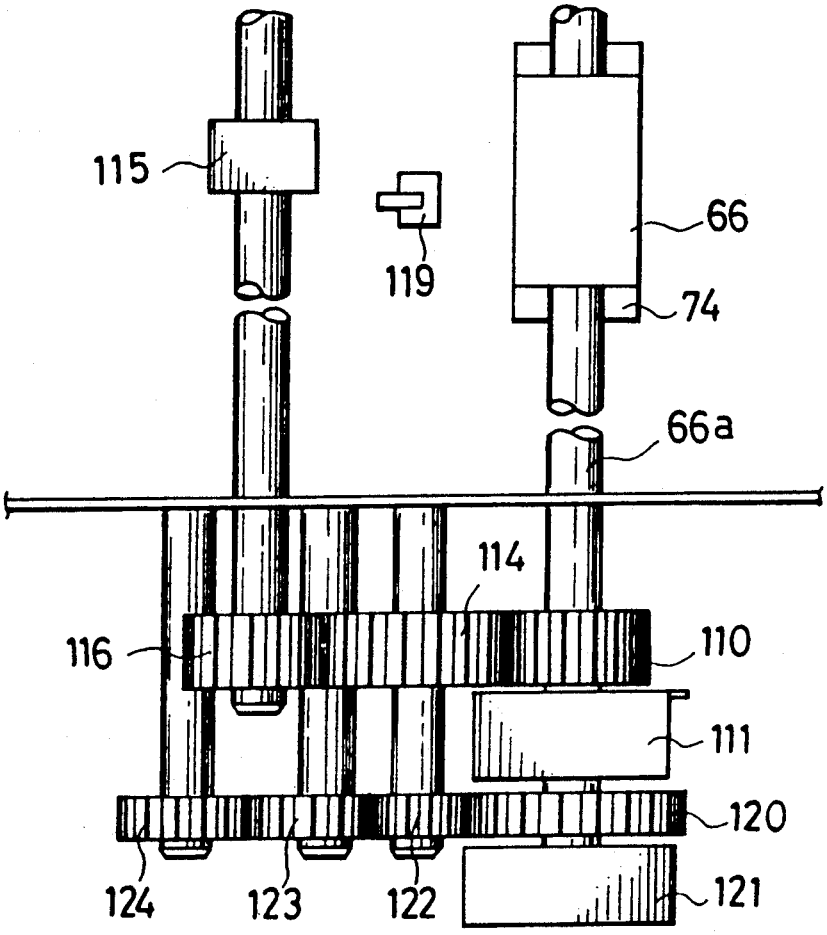
FIG. 8 is a plan view which illustrates an essential portion of the sheet feeder of a copying machine according to another embodiment of the present invention.
Figure 9:
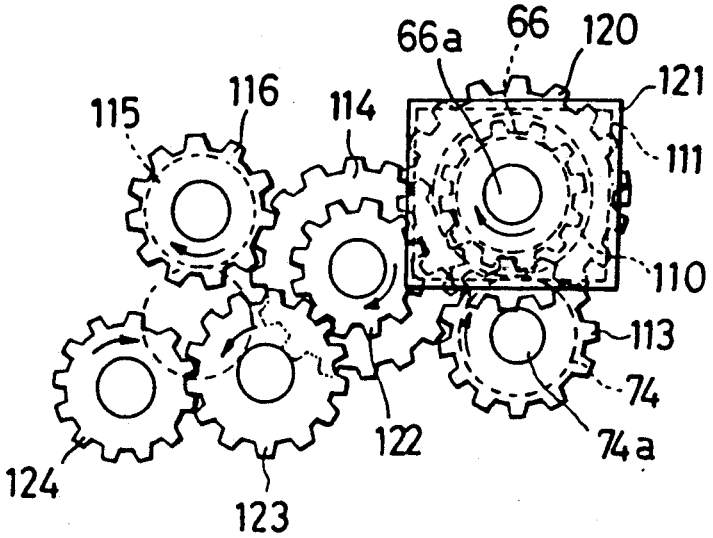
FIG. 9 is a side elevational view of the sheet feeder shown in FIG. 8.

As shown in FIGS. 8 and 9, the driving system for rotating the feed roller 66 is so arranged that a gear 120 and a reverse-rotation control clutch 121 for controlling the reverse rotation caused by the gear 120 are disposed at the leading edge of the rotational shaft 66*a*. The gear 120 is engaged to a gear 122 coaxially provided with the idle gear 114. A gear 123 is engaged to the gear 122, and a gear 124 is engaged to the gear 123. Thus, a rotational force from a driving source (omitted from illustration) can be transmitted to the gear 120 by a gear group consisting of the above-described gears.

According to this embodiment, the structure is arranged such that the following relationship according to the above-described first embodiment are held:

$$\mu 2\ F1d/2 > T2. \quad \text{Equation (2)}$$

and $$\mu 1\ F1d/2 > T1. \quad \text{Equation (3)}$$

In addition, the following relationship must be held according to this embodiment:

$$\mu 1 > \mu 2 > \mu 4$$

Figure 10:
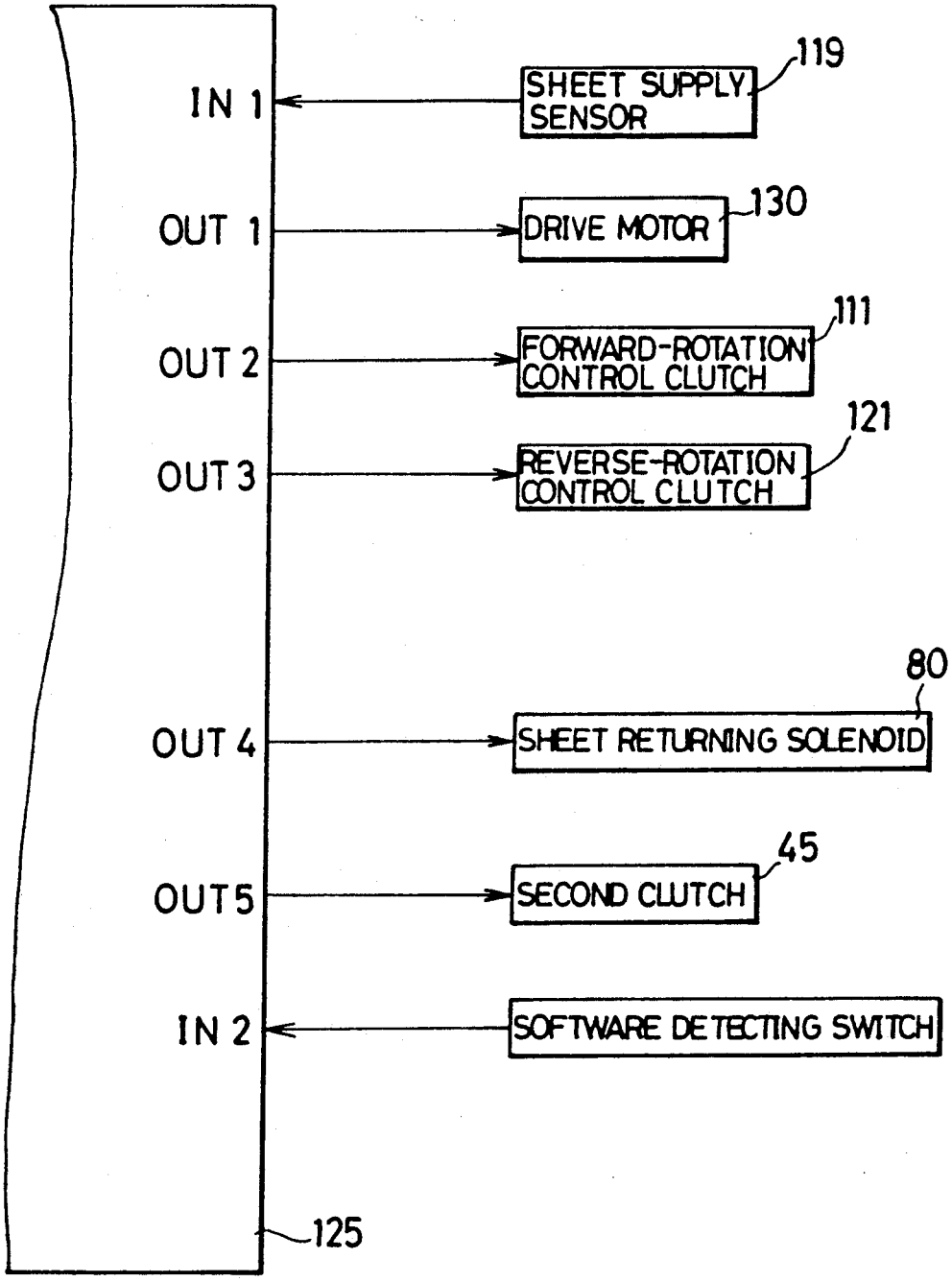
FIG. 10 schematically illustrates the connection established between a microcomputer and the sheet feeder in the copying machine according to this embodiment.

As shown in FIG. 10, the sheet supply sensor 119 for detecting a copying sheet being passed, a drive motor 130 serving as a driving source for a roller, the forward-rotation control clutch 111, the reverse-rotation control clutch 121 and the like are connected to a microcomputer 125. As a result, the sheet supply sensor 119 transmits a detection signal of the copying sheet to the microcomputer 125. On the other hand, the drive motor 130 and the two clutches 111 and 121 are arranged to be operated in receipt of a control signal transmitted by the microcomputer 125.

In the thus structured sheet supply mechanism 62, the following control is conducted. The feed roller 66 is supplied with reversed rotational force for a predetermined time period after the copying sheet to be fed has passed through the feed roller 66. Furthermore, rotational force is arranged to be applied to the reverse roller 74 for at least a predetermined time period.

Figure 11:
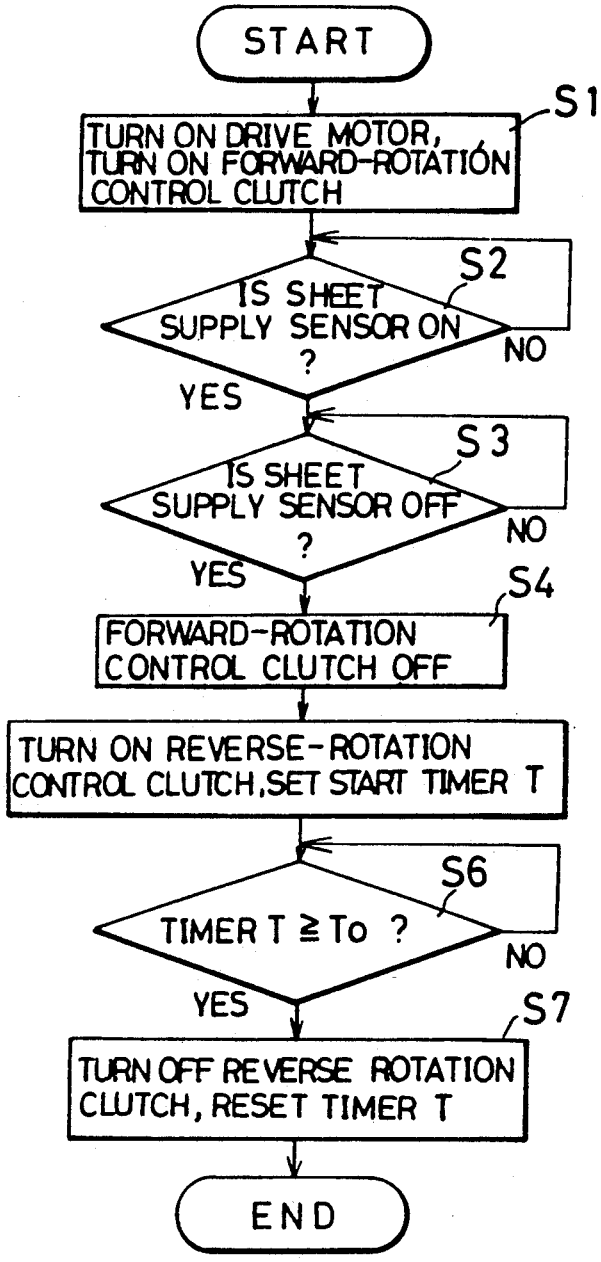
FIG. 11 is a flow chart which illustrates the operation for controlling the sheet feeder according to this embodiment.

Then, the operation will now be described with reference to a flow chart shown in FIG. 11. In step S1, transmission of driving force is started by the drive motor 130 and the forward-rotation control clutch 111. In step S2, the sheet supply sensor 119 determines whether or not the copying sheet has passed. If it is determined that the copying sheet is passing in accordance with the fact that the sheet supply sensor 119 has been turned on, the flow advances to step S3. In step S3, it is determined whether or not the sheet supply sensor 119 has been turned off. If it has been detected that the copying sheet had passed through the feed roller 66 since the sheet supply sensor 119 had been turned off, the above-described forward-rotation control clutch 111 is turned off so that the transmission of the driving force is stopped in step S4. Then, the reverse-rotation control clutch 121 is turned on so that reverse rotational force is supplied to the feed roller 66 and a timer T of the microcomputer 125 is set in step S5. It is then determined whether or not the timer T reaches a predetermined value T0 in step S6. If it has been determined that the value of the time T is shorter than T0, the flow advances to step S7 in which the reverse-rotation control clutch 121 is turned off and the timer T is reset. Thus, the copying sheet which must not be fed can be returned during the setting time for the timer T.

According to the above-described structure, the similar operation can be conducted and the similar effect can be obtained to those according to the first embodiment. Furthermore, since reverse rotational force is supplied to the feed roller 66 for a predetermined time period after the copying sheet to be fed has passed through the feed roller 66, the feed roller 66 assists the sheet returning operation. Therefore, copying sheet can be returned further assuredly. Furthermore, the life of each of the above-described feed roller 66, the reverse roller 74, the spring frictional member 121 and the like can be lengthened.

Many widely different embodiments of the present invention may be constructed without departing from the spirit and scope of the present invention. It should be understood that the present invention is not limited to the specific embodiments described in this specification, except as defined in the appended claims.

What is claimed is:

1. An apparatus for controlling a sheet supplying device which has a feeding device capable of feeding a copying sheet from a sheet stacking portion and a reversing device capable of returning copying sheets desired not to be fed to said sheet stacking portion, said apparatus comprising:

a first means for driving said feeding device to be rotated so as to draw a copying sheet out of said sheet stacking portion;

a second means for driving said reversing device to be rotated so as to return a copying sheet desired not to be fed to said sheet stacking portion at a time when a plurality of copying sheets are simultaneously fed out from said sheet stacking portion;

means for detecting said copying sheet being passed on said feeding device; and means for controlling both of said first driving means and said second driving means so as to rotate said reversing device for a predetermined time at every instance after said first driving means stops driving said feeding device in response to said detecting means.

2. An apparatus according to claim 1, wherein said apparatus further comprises a conveyance means for conveying said copying sheet fed out from said sheet stacking portion by said feeding device, and a sheet guide disposed between said feeding device and said conveyance means for guiding said copying sheet fed from said feeding device to said conveyance means.

3. An apparatus according to claim 2, wherein said detecting means is a feed sensor disposed at said sheet guide for detecting a passing of said copying sheet to be fed from said feeding device to said conveyance means.

4. An apparatus according to claim 2, wherein said second driving means includes a rotatable shaft engaged to said reversing device and a first gear secured to an ending edge of said rotatable shaft so as to rotate said reversing device in a direction.

5. An apparatus according to claim 2, wherein said feeding device, said reversing device and said conveyance means are rollers adapted to be rotated in any rotation directions in accordance with said controlling means.

6. An apparatus according to claim 1, wherein said first driving means includes a rotatable shaft engaged to said feeding device so as to rotate said feeding device, said rotatable shaft having a first gear and wherein said second driving means includes a second shaft with a second gear being disposed at an ending edge thereof.

7. An apparatus according to claim 6, wherein said first driving means further includes an idle gear engaged to both of said first gear and said second gear, and a third gear engaged to said idle gear for driving said conveyance means.

8. An apparatus according to claim 6, wherein said rotational shaft of said feeding device has a reverse rotation control clutch disposed at a leading edge thereof for controlling a reverse rotation caused by said first gear so as to rotate said feeding device in another direction.

9. An apparatus according to claim 1, wherein said sheet stacking portion is a rotatable sheet cassette adapted to be rotated so as to change a supplying direction of said copying sheets stacked therein, and said rotatable sheet cassette being adapted to stack a plurality of copying sheet to be drawn by said feeding device.

10. An apparatus for controlling a sheet supplying device having a feeding device capable of feeding a copying sheet from a plurality of stacked copying sheets in a sheet stacking portion formed of a rotatable cassette, and a reversing device capable of returning copying sheets desired not to be fed at an instance of feeding process, said apparatus comprising:

a first applying means for applying a rotational driving force to said feeding device so as to draw a copying sheet out of said stacked copying sheets in said sheet stacking portion by rotating said feeding device in one direction:

a second applying means for applying a rotational driving force to said reversing device so as to return a copying sheet desired not to be fed to said sheet stacking portion at a time when a plurality of copying sheets are simultaneously fed out from said sheet stacking portion by rotating said reversing device in another direction;

a first gear disposed at an ending edge of a rotatable shaft of said feeding device; and means for controlling both of said first applying means and said second applying means so that said rotational driving force applied to said feeding device is stopped at a time when a copying sheet to be fed has passed on said feeding device, and for controlling said rotational driving force applied to said reversing device being kept to apply to said reversing device at least for a predetermined time period after stopping to apply said rotational driving force to said feeding device, said controlling means having a sheet guide arranged between said feeding device and a conveyance roller for guiding said copying sheet transmitted by said feeding device to said conveyance roller, an idle gear which is engaged to both said first gear and a second gear disposed at an ending edge of a rotatable shaft of said reversing device, a third gear engaged to said idle gear for driving said conveyance roller adapted to transmit said copying sheet to said sheet guide, and a feed sensor disposed at said sheet guide for detecting a passing of said copying sheet transmitted from said feeding device.

11. An apparatus according to claim 10, wherein said controlling means further includes a pressure release lever having an L-shape driving member which is interposed between said rotatable shafts, said pressure release lever being adapted to rotate vertically at a shaft thereof such that at a time when said pressure release lever is rotated downwardly, said L shape driving member holds said rotatable shaft of said reversing device so that said reversing device is separated from said feeding device.

12. An apparatus according to claim 11, wherein said controlling means further includes a sheet return plate disposed between a pull-in roller and said feeding device so as to be rotated vertically relative to a shaft disposed above a pin of driving shaft of said sheet return plate for returning a copying sheet toward said sheet stacking portion.

13. An apparatus according to claim 12, wherein said sheet return plate has a returning member disposed on two sides of said feeding device, said returning member extending close to a tangent line between said feeding device and said reversing device, said returning member acting to push and to return a leading edge of a copying sheet which has been stopped on said tangent line toward a rotatable plate.

14. An apparatus according to claim 12, wherein said controlling means further includes a sheet detection switch and a no-sheet detection switch disposed on two sides of said pull-in roller on a support frame, each of said two detection switches has a drive member respectively so that said two detection switches are operated at a time when said two switches are pushed by a sheet supplying portion of said rotatable plate being lifted.

15. An apparatus according to claim 14, wherein said rotatable plate has a longitudinal sheet supplying portion and a sideway supplying portion, each of said portions having a cut at a position corresponding to a drive member of said no-sheet detection switch so that said no-sheet detection switch is not turned on and only said sheet detection switch is turned on at a time when there is not copying sheet on said rotatable plate, and both direction switches are turned on at a time when copying sheets are stacked.

16. An apparatus according to claim 10, wherein said reversing device is attached in an attachment plate disposed below said feeding device such that a time when said reversing device rotates in a direction which is the same rotational direction as said feeding device said copying sheet which is desired not be fed is returned, said attachment plate including two end shafts supported by said sheet guide capable of rotating vertically so that said reversing device presses and/or releases said feeding device.

17. An apparatus according to claim 16, wherein said attachment plate is urged in a direction in which said reversing device is brought into contact with said feeding device by using a spring.

18. An apparatus according to claim 17, wherein said reversing device is attached to a first rotatable shaft which transmits rotational force to said reversing device via a tongue limiter, and first rotatable shaft is disposed below a second rotatable shaft of said feeding device in parallel with said second rotatable shaft, and said second rotatable shaft is adapted to exert a driving force to said reversing device so that said first rotatable shaft is idle at a time when a resistance acts on said reversing device.

19. An apparatus for controlling a sheet supplying device having a feeding device capable of feeding a copying sheet from a plurality of stacked copying sheets in a sheet stacking portion and a reversing device capable of returning copying sheets desired not to be fed at an instance of feeding process, said apparatus comprising:

means for applying a rotational driving force to said feeding device so as to draw a copying sheet out of said stacked copying sheets in said sheet stacking portion by rotating said feeding device in one direction;

means for applying a rotational driving force to said reversing device so as to return a copying sheet desired not to be fed to said sheet stacking portion at a time when a plurality of copying sheets are simultaneously fed out from said sheet stacking portion by rotating said reversing device in another direction;

means for controlling both of said applying means such that said rotational driving force applied to said feeding device is stopped at a time when a copying sheet to be fed has passed on said feeding device and said rotational driving force applied to said reversing device is kept to apply to said reversing device at least for a predetermined time period after stopping to apply said rotational driving force to said feeding device; and an attachment plate, attached to said reversing device, disposed below said feeding device such that at a time when said reversing device rotate in a direction which is the same rotational direction as said feeding device said copying sheet which is desired not be fed is returned, said attachment plate including two end shafts supported by a sheet guide capable of rotating vertically so that said reversing device presses and/or releases said feeding device.

* * * * *

UNITED STATES PATENT AND TRADEMARK OFFICE

CERTIFICATE OF CORRECTION

PATENT NO. : 5,076,563

DATED : December 31, 1991

INVENTOR(S) : Toyoaki Namba et al.

It is certified that error appears in the above-identified patent and that said Letters Patent is hereby corrected as shown below:

On the title page: Item[75]:

Please change "Koriyama" to --Yamato-Koriyama--.

Signed and Sealed this

Twenty-seventh Day of April, 1993

*Attest:*

*Attesting Officer*

MICHAEL K. KIRK

*Acting Commissioner of Patents and Trademarks*